US006901766B1

(12) United States Patent
Jin et al.

(10) Patent No.: US 6,901,766 B1
(45) Date of Patent: Jun. 7, 2005

(54) COIL DRAIN PAN APPARATUS

(75) Inventors: Changjiang Jin, Van Buren, AR (US); Phillip Guy Brown, Fort Smith, AR (US); Carl Bergt, Alma, AR (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 10/753,594

(22) Filed: Jan. 8, 2004

(51) Int. Cl.[7] ..... F25D 21/14
(52) U.S. Cl. ..... 62/286; 62/291
(58) Field of Search ..... 62/286, 291, 285, 62/288

(56) References Cited

U.S. PATENT DOCUMENTS

| | | | | |
|---|---|---|---|---|
| 3,102,654 A | * | 9/1963 | Millman et al. | 220/571 |
| 4,088,466 A | | 5/1978 | Humphrey et al. | 63/286 |
| 4,129,013 A | | 12/1978 | Hine, Jr. | 62/285 |
| 5,071,027 A | * | 12/1991 | Sullivan | 220/571 |
| 5,105,630 A | | 4/1992 | Kim | 62/285 |
| 5,207,074 A | | 5/1993 | Cox et al. | 62/285 |
| 5,511,386 A | | 4/1996 | Russ et al. | 62/285 |
| 5,664,430 A | | 9/1997 | Karman | 62/285 |
| 5,697,227 A | | 12/1997 | Bruce et al. | 62/285 |
| 5,964,370 A | | 10/1999 | Rust, Jr. et al. | 220/571 |
| 5,979,171 A | | 11/1999 | Mitchell et al. | 62/288 |
| 6,112,536 A | | 9/2000 | Hansen | 62/285 |
| 6,405,552 B1 | | 6/2002 | Hubert et al. | 62/285 |

OTHER PUBLICATIONS

Carrier "Evaporator Coils" Brochure Sheets (2)—2003.

* cited by examiner

*Primary Examiner*—Melvin Jones
(74) *Attorney, Agent, or Firm*—Konneker & Smith, P.C.

(57) ABSTRACT

An air conditioning cooling coil and its associated drain pan are positionable in either a vertical or horizontal air flow orientation. With the drain pan in its vertical air flow orientation, generally horizontally disposed drainage trough portions of the drain pan around its periphery are sloped relative to one another in a manner such that all coil condensation received in the troughs flows by gravity therethrough into a downwardly projecting condensate well and outwardly through an outlet opening therein. When the drain pan is in its horizontal air flow orientation, the troughs are disposed generally in a vertical plane, and coil condensation falls on a specially designed horizontal drip shield, which may be connected to the pan without tools, separate fasteners or sealing material, and drains along the drip shield into one of the pan troughs for discharge from the main drain opening of the pan.

29 Claims, 5 Drawing Sheets

COIL DRAIN PAN APPARATUS

BACKGROUND OF THE INVENTION

The present invention generally relates to air conditioning apparatus and, in representatively illustrated embodiments thereof, more particularly relates to condensate drain pan structures used in conjunction with air conditioning cooling coils.

A coil used in air conditioning apparatus such as furnaces, air handling units, and heat pumps extracts moisture from the air which is being flowed externally across the coil (by a blower portion of the apparatus) and cooled by the coil for delivery to a conditioned space served by the apparatus. This moisture extraction creates condensation (water) on the exterior of the coil which drips from the coil into an associated drain pan structure within the air conditioning apparatus. Coil condensation dripping into the pan flows away therefrom by gravity via a condensate drain line suitably connected to the pan. While this general approach to coil condensate removal has long been utilized and is generally suitable for its intended purpose, it typically presents several well known problems, limitations and disadvantages.

For example, an air conditioning apparatus (such as a furnace, air handling unit or heat pump) incorporating a cooling coil therein may customarily be fabricated in either (1) a vertical configuration in which air is to be operationally flowed upwardly or downwardly through the cooling coil, or (2) a horizontal configuration in which air is to be operationally flowed horizontally in one of two opposite directions through the coil. To permit a given vertical air flow coil/drain pan subassembly to be utilized in a horizontal air flow application (in which the associated drain pan is vertically oriented) it is typically necessary to attach to the re-oriented drain pan a horizontal drip shield structure to catch the condensate falling from the coil. Attachment of the auxiliary drip shield structure to the drain pan tends to be a fairly tedious procedure requiring the use of separate fasteners, and the application of a suitable sealing material at the joint between the pan and the shield. Such fabricational complexity undesirably adds to the overall cost of the air conditioning apparatus.

Additionally, condensate drain pans of conventional constructions often present problems associated with the coil condensate which they receive. Such problems arise from the often unavoidable presence of standing water within the pans for long periods of time, and include sweating of the pans, fungus growth, and reduction in the quality of air delivered to the conditioned space.

As can readily be seen from the foregoing, a need exists for a coil drain pan structure which eliminates or at least substantially eliminates the above-mentioned problems, limitations and disadvantages of conventionally constructed coil drain pans. It is to this need that the present invention is directed.

SUMMARY OF THE INVENTION

In carrying out principles of the present invention, in accordance with representatively illustrated embodiments thereof, air conditioning apparatus is provided which is representatively in the form of an air conditioning unit having has operatively incorporated therein a cooling coil for lowering the temperature of supply air internally traversing the apparatus. The air conditioning apparatus may be utilized in either a vertical air flow or horizontal air flow orientation, and is provided with a specially designed condensate drain pan structure for receiving and draining away condensation dripping off the cooling coil during its operation. While the coil is representatively a cooling coil, the present invention is not limited to cooling coils, with the term "air conditioning" as used herein encompassing both heating and cooling applications.

According to one aspect of the invention, the coil drain pan is selectively positionable in horizontal and vertical air flow orientations and includes a drain structure having an outlet opening therein, and a plurality of interconnected troughs, in drainage flow communication with the outlet opening. The drain structure includes a wall area which projects downwardly beyond the interconnected troughs and is in fluid flow communication herewith, the outlet opening extending through a wall portion of the well area. The interconnected troughs representatively border a generally rectangular air flow opening and, when the drain pan is in its vertical air flow orientation, lie generally in a horizontal plane, are positioned above the outlet opening, and are sloped relative to one another in a manner such that essentially all condensation entering any of the troughs flows by gravity to and outwardly through the outlet opening, thereby substantially eliminating standing water in the drain pan structure.

To permit the drain pan to be utilized in its horizontal air flow orientation, with the trough portion lying generally in a vertical plane, a drip shield structure is removably connected to the trough portion of the drain pan to lie generally in a horizontal plane and receive condensate from the cooling coil and drain the received condensate into one of the drain pan troughs for discharge therefrom through the outlet opening. According to another feature of the invention, the drip shield structure is connectable to the drain pan trough portion without the use of separate fasteners, tools, or sealant material.

Illustratively, the drip shield structure is press-fittable onto a support wall extending outwardly from one of the drain pan troughs using resilient tabs formed on the support wall, and lanced-out locking barbs formed on an edge portion of the drip shield structure. The drip shield edge portion is pressed into spaces between the resilient tabs and the support wall to outwardly deflect the tabs and bring the barbs into locking engagement with inner side surface portions of the tabs.

BRIEF DESCRIPTION OF THE DRAWINGS

FIG. 5 is an enlarged scale cross-sectional view through a portion of the drain pan/drip shield assembly taken along line 5—5 of FIG. 4;

DETAILED DESCRIPTION

Figure 1:
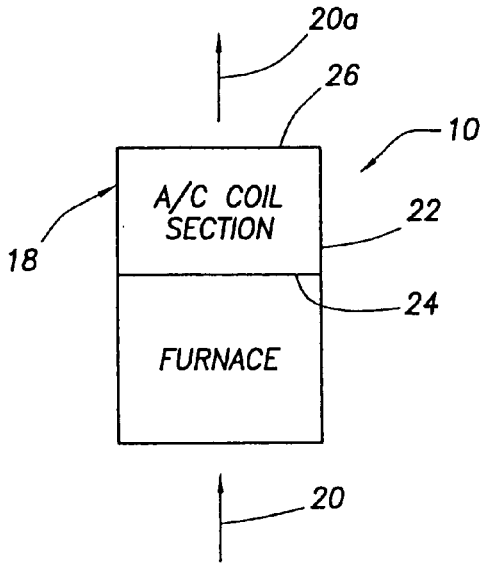
FIGS. 1 and 1A, respectively, are schematic side elevational views of vertical flow and horizontal flow furnaces incorporating therein air conditioning coil sections embodying principles of the present invention.
Figure 1A:
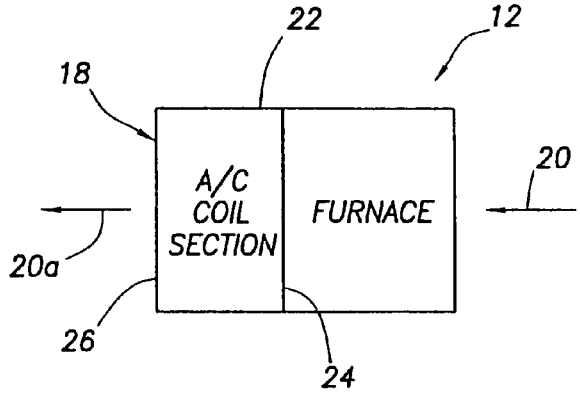
Figure 2:
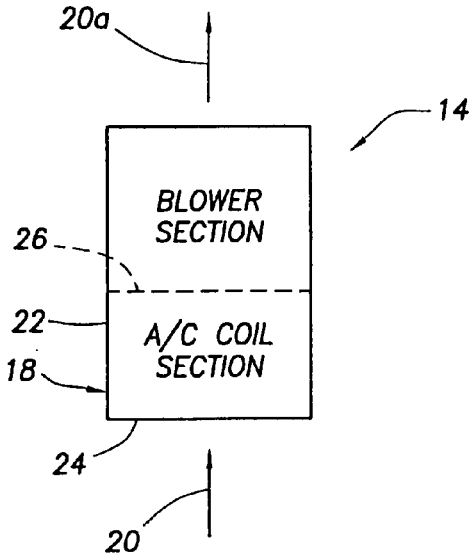
FIGS. 2 and 2A, respectively, are schematic side elevational views of vertical flow and horizontal flow air handling units incorporating therein similar air conditioning coil sections embodying principles of the present invention.
Figure 2A:
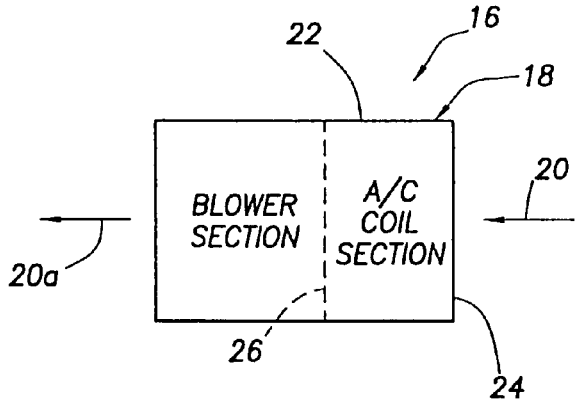

Schematically depicted in FIGS. 1–2A are four representative types of air conditioning apparatus embodying principles of the present invention—(1) a vertical air flow furnace 10 shown in FIG. 1; (2) a horizontal air flow furnace 12 shown in FIG. 1A; (3) a vertical air flow air handling unit 14 shown in FIG. 2; and (4) a horizontal air flow air handling unit 16 shown in FIG. 2A. Each of these four illustrative units incorporates therein a specially designed air conditioning coil section 18, and is operative to flow air 20 from a conditioned space therethrough, with the air exiting the unit as cooled air 20*a*, for return to the conditioned space, during operation of the coil section 18.

As used herein, the term "air conditioning" is intended to encompass both cooling and heating applications. Thus, while the air conditioning coil section 18 is illustratively a cooling coil section, it could alternatively be a heating coil section without departing from principles of the present invention. Also, the air flow in the units 10 and 14 could alternatively be downwardly directed, and the air flow in the units 12 and 16 could alternatively be rightwardly directed. Further, the coil section 18 could be mounted in other types of air conditioning units such as in a heat pump, or simply mounted in a duct, without departing from principles of the present invention.

Figure 3:
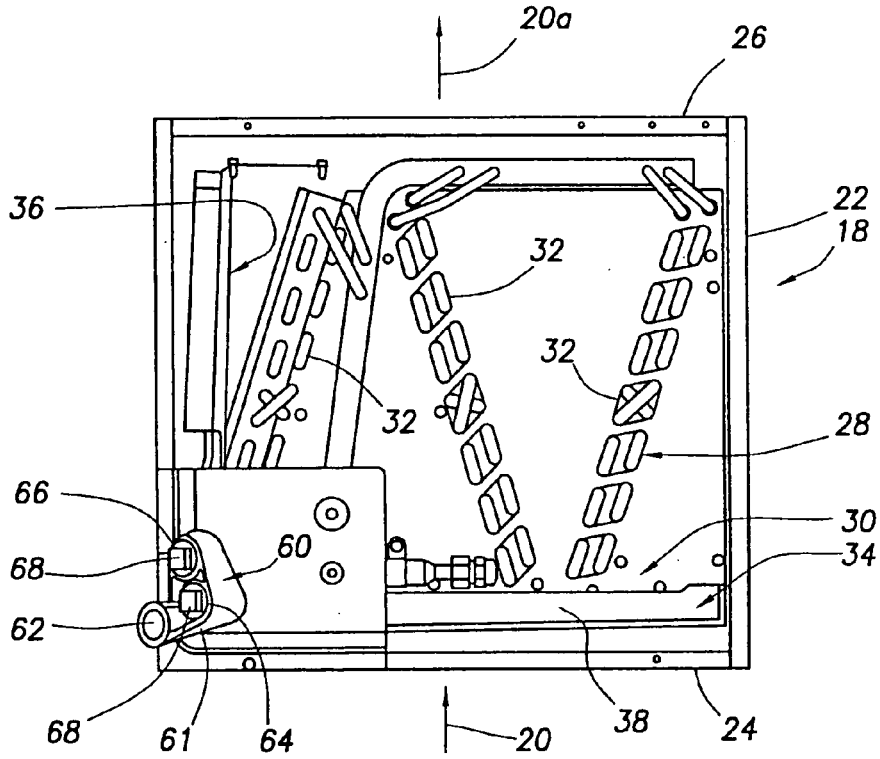
FIG. 3 is an enlarged scale cut away side elevational view of one of the vertically oriented air conditioning coil sections.
Figure 3A:
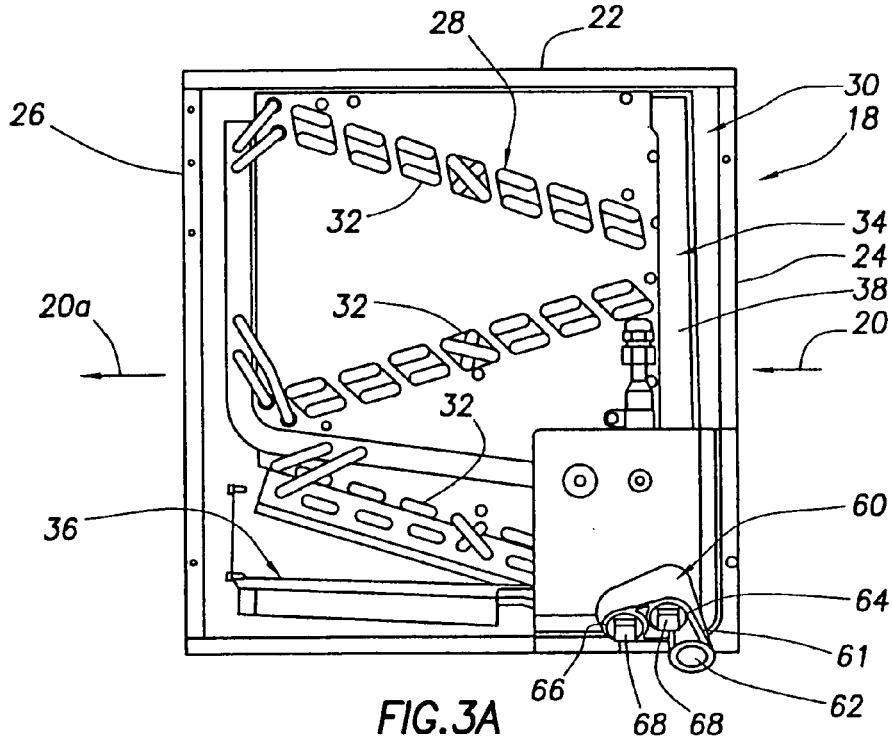
FIG. 3A is an enlarged scale cut away side elevational view of one of the horizontally oriented air conditioning coil sections.

The coil section 18, shown in a vertical air flow orientation in FIG. 3 and in a horizontal air flow orientation in FIG. 3A, includes a rectangular outer housing 22, having opposite inlet and outlet openings 24 and 26, in which an air conditioning cooling coil 28 is disposed and operatively associated with a specially designed drain pan structure 30 adapted to receive and drain away condensate (i.e., water) dripping from the coil 28 during it operation. Representatively, the coil 28 is a direct expansion type refrigerant coil having three alternatingly sloped sections 32, but could be another type of cooling coil, such as a chilled water cooling coil or a heat pump coil, and have a different configuration, without departing from principles of the present invention.

Figure 4:
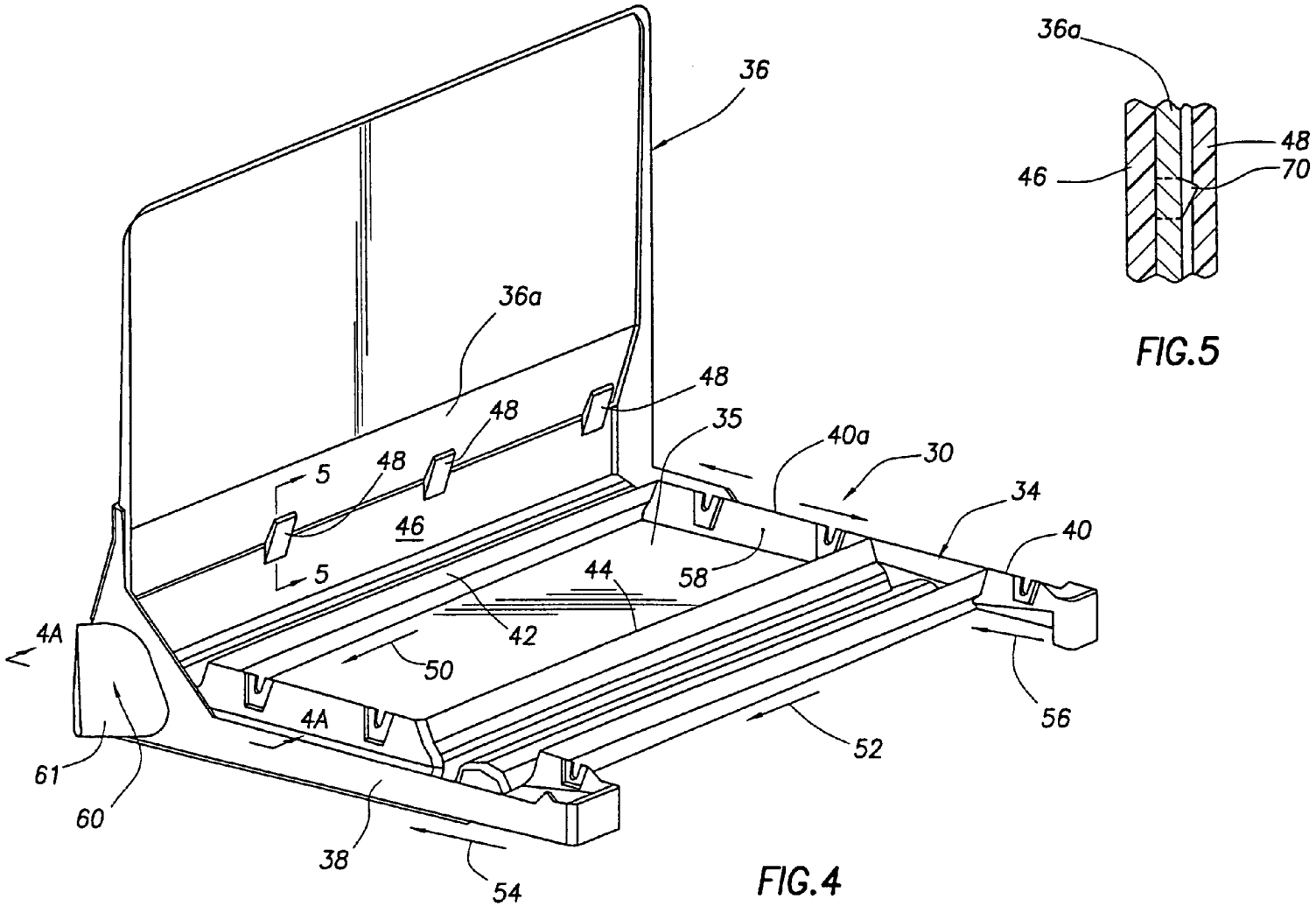
FIG. 4 is a front and right side perspective view of a specially designed drain pan/drip shield subassembly used in the air conditioning coil sections.
Figure 6:
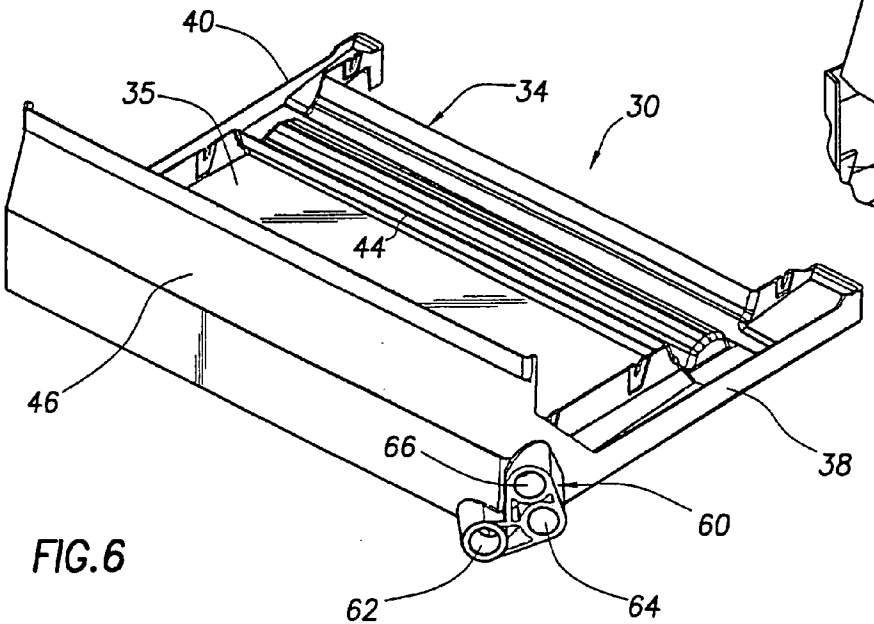
FIG. 6 is a front and left side perspective view of the trough portion of the FIG. 4 drain pan/drip shield subassembly.

Turning now to FIGS. 4 and 6, the drain pan structure 30 includes a rectangular, generally frame-shaped trough portion 34 which borders an air flow opening 35 and is representatively of a molded plastic construction, and a generally rectangular drip shield structure 36 (which has been removed from the drain pan structure 30 in FIG. 6 for illustrative purposes) which is formed from a suitable material such as, for example, plastic or sheet metal. With the drain pan 30 in its vertical air flow orientation shown in FIGS. 4 and 6, the trough portion 34 is generally horizontally oriented and includes spaced apart, parallel and facing front and rear trough portions 38 and 40, and spaced apart parallel and facing left and right trough portions 42 and 44 which are transverse to the troughs 38 and 40. For purposes later described herein, the left side of the trough 42 has an upstanding support wall 46 formed thereon and having four mutually spaced apart, upwardly projecting resilient tabs 48 formed on its inner side surface. While the representatively illustrated trough portion 34 has four interconnected troughs, it will be readily appreciated by those of ordinary skill in this particular art that it could alternatively have a greater or lesser number of interconnected troughs, if desired, without departing from principles of the present invention.

With the drain pan 30 in its vertical air flow orientation shown in FIGS. 4 and 6, all of the troughs 38,40,42,44 are sloped in a manner such that condensation from the cooling coil 28 (see FIG. 3) entering any of the troughs flows downwardly by gravity to the junction of the troughs 38 and 42 (i.e., to the left corner of the overall troughs portion 34 as viewed in FIG. 4). Specifically, as viewed in FIG. 4, the left and right troughs 42,44 slope downwardly toward trough 38 as indicated by the arrows 50 and 52, trough 38 slopes downwardly toward the trough 42 as indicated by the arrow 54, and an outer or right end portion of the trough 40 slopes downwardly toward the trough 44 as indicated by the arrow 56. The portion 40*a* of the trough 40 between the troughs 42 and 44 is sloped in opposite directions from a longitudinally intermediate point 58, with a left section of the trough portion 40*a* sloping downwardly toward the trough 42, and a right section of the trough portion 40*a* a sloping downwardly toward the trough 44.

Figure 4A:
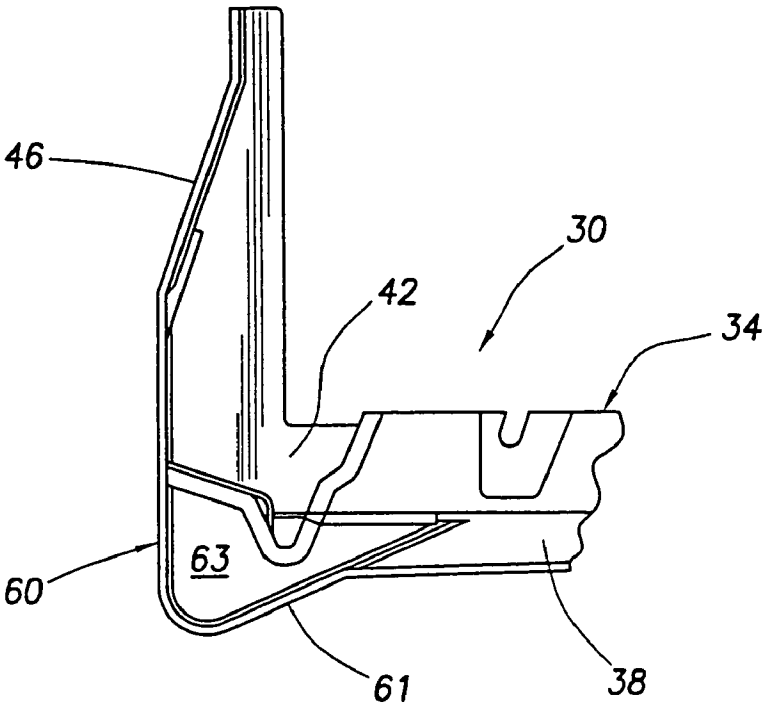
FIG. 4A is a simplified cross-sectional view through a corner portion of the drain pan/drip shield subassembly taken along line 4A—4A of FIG. 4.

Accordingly, with the drain pan 30 in its vertical air flow orientation cooling coil condensation received by any of the troughs 38,40,42,44 flows by gravity to the juncture of the troughs 38 and 42 which forms the low point of the interconnected troughs 38,40,42 and 44. Disposed at this low point of the interconnected troughs is a drain structure 60 comprising a well area 61 (see FIG. 4A) which projects downwardly beyond the juncture of the troughs 38 and 42 and serves as a condensate disposal area which is positioned below the troughs and their associated coil. Well 61 has an inner wall 63 (see FIG. 4A), a main condensate outlet opening 62 (see FIGS. 3 and 6), a vertical orientation condensate overflow opening 64, and a horizontal orientation condensate overflow opening 66. Conventional condensate drain tubing (not shown) may be appropriately connected to these openings during field installation of the air conditioning apparatus in which the drain pan 30 is incorporated, and the overflow openings 64,66 are adapted to receive removable plugs 68 as shown in FIGS. 3 and 3A.

With the drain pan 30 in its vertical air flow orientation, the main outlet opening 62, which communicates with the interior of the well 61, and the vertical overflow opening 64 is slightly higher than the main outlet opening 62. Thus, when the drain pan 30 is in its vertical air flow orientation, substantially all of the coil condensation entering the trough portion 34 flows by gravity into the downwardly projecting well 61 and is discharged by gravity through the main outlet opening 62, thereby substantially eliminating standing drain pan water and its attendant problems such as sweating, fungus growth and reduced indoor air quality. Should the main outlet opening 62 be restricted or blocked, the pan-received condensation is simply discharged through the back-up overflow opening 64. The downwardly projecting well 61 acts as a condensate collection area to hold only a small amount of condensate before it is discharged through opening 62, thus preventing or minimizing the growth of mold and mildew that can be exposed to the indoor airstream.

Referring now to FIG. 3A, with the drain pan 30 and its associated cooling coil 28 in their horizontal air flow orientations, the trough portion 34 lies generally in a vertical plane, and the generally flat pan-shaped drip plate structure 36 underlies the coil 28 to receive condensation dripping therefrom, lies generally in a horizontal plane, and is sloped slightly downwardly toward the trough 42 (see FIG. 4) which now forms a lower edge section of the vertically disposed trough portion 34. Coil condensation received by the drip plate structure 36 flows therethrough by gravity into the trough 42 for discharge through main outlet opening 62 in the drain structure 60 via the downwardly projecting well 61. In the event that the main outlet opening 62 becomes restricted or clogged, this condensation simply flows outwardly through the horizontal overflow opening 66 which is now positioned somewhat above the main outlet opening 62.

In accordance with a feature of the present invention, the drip plate structure 36 may be removably and operatively connected to the support wall 46 of the trough portion 34, without the use of separate fasteners or joint sealant material, by simply press-fitting the drip plate structure 36 onto the support wall 46 as will now be described with reference to FIGS. 4, 5, 7 and 8.

Figure 7:
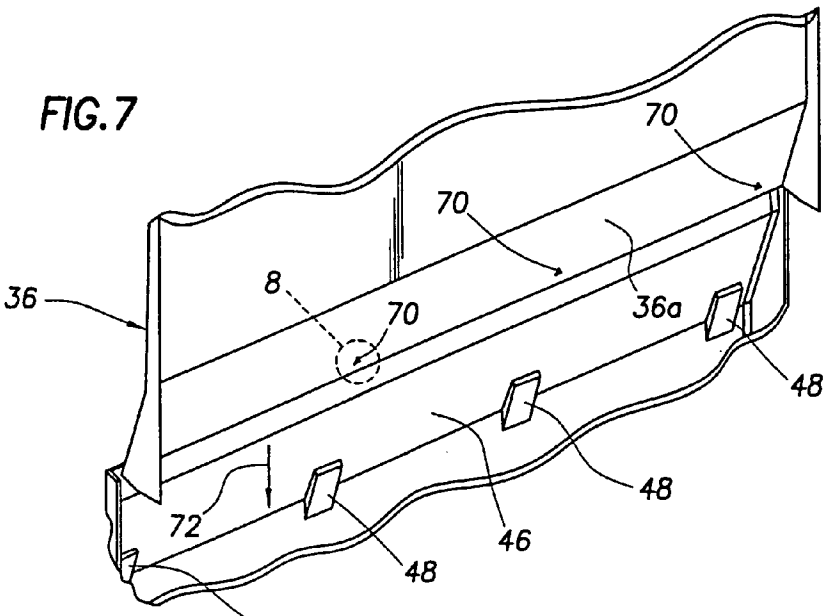
FIG. 7 is an exploded perspective view of the drain pan/drip shield interface area of the drain pan/drip shield subassembly shown in FIG. 4.
Figure 8:
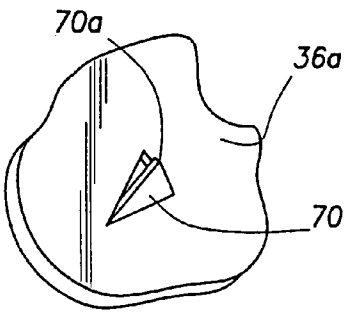
FIG. 8 is an enlarged scale detail view of the dashed circle area "8" in FIG. 7.

As best illustrated in FIGS. 7 and 8, a horizontally spaced plurality of lanced-out triangular locking barbs 70 are formed in a lower edge portion 36*a* of the drip plate structure 36 and are alignable with the tabs 48 on the support wall 46. To quickly attach the drip plate structure 36 to the support wall 46, the barbs 70 are aligned with the tabs 48, and the lower drip plate edge portion 36*a* is pushed downwardly toward the support wall 46, as indicated by the arrow 72 in FIG. 7, until the lower drip plate edge portion 36*a* and its associated locking barbs 70 are forced downwardly between the support wall 46 and the resilient tabs 48, as cross-sectionally depicted in FIG. 5, to bring the drip plate structure 36 to its installed orientation as shown in FIG. 4.

This laterally outwardly deflects the resilient tabs 48 and causes upper end points 70*a* on the barbs 70 (see FIG. 8) to engage the inner sides of the outwardly deflected tabs 48 in a manner releasably locking the drip plate structure 36 on the trough structure 34 without the use of any separate fasteners or tools of any sort. Since, with the drain pan 30 in its horizontal air flow orientation, the inner edge portion 36*a* of the drip plate 36 overlies the top side of the horizontally oriented support wall 46, no sealant material need be utilized at the juncture between the support wall 46 and the drip plate structure 36. This feature of the present invention advantageously simplifies the assembly of the coil/drain pan subassembly and thus reduces the fabrication cost for the overall air conditioning apparatus in which it is operatively incorporated.

Figure 9:
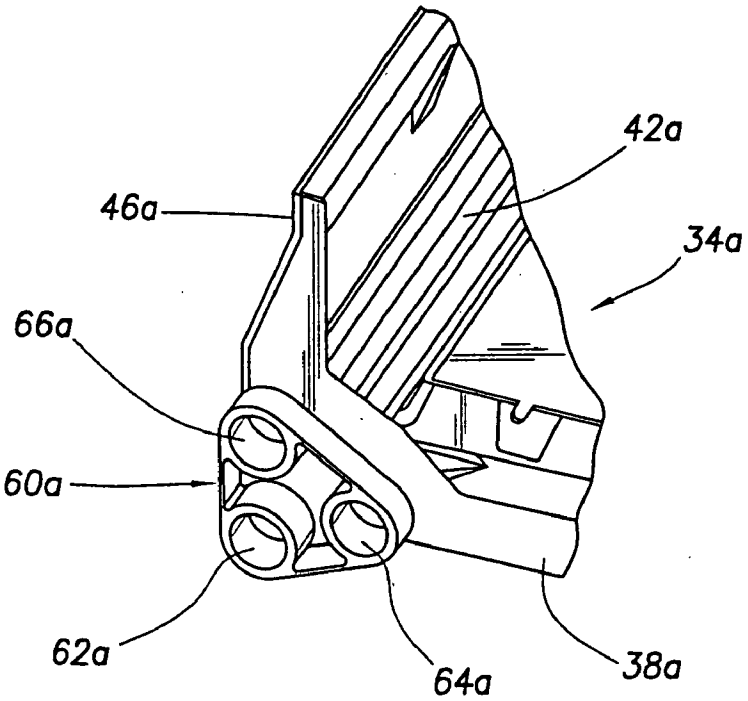
FIG. 9 is a perspective view of a corner portion of an alternate embodiment of the trough part of the drain pan/drip shield subassembly.

A drain corner area of an alternate embodiment 34*a* of the previously described drain pan trough portion 34 is perspectively illustrated in FIG. 9. In order to facilitate a comparison of the drain portion embodiments 34 and 34*a*, components in the embodiment 34*a* similar to those in the embodiment 34 have been given identical reference numerals with the subscripts "a". The trough structure 34*a* is substantially identical to the previously described trough structure 34 with the exception that in the trough structure 34*a* the drain structure 60*a* extends outwardly from the trough structure 34*a* in a direction substantially parallel to the length of the trough 42*a*, whereas in the previously described trough structure 34 the drain structure 60 is leftwardly angled as viewed in FIG. 4.

The foregoing detailed description is to be clearly understood as being given by way of illustration and example only, the spirit and scope of the present invention being limited solely by the appended claims.

What is claimed is:

1. Air conditioning apparatus comprising:

a coil drain pan positionable in a vertical air flow orientation and including:

a drain structure including a condensate well having an outlet opening therein, and a plurality of interconnected troughs connected to said condensate well for receiving condensation from a coil, said interconnected troughs, when said drain pan is in said vertical air flow orientation, being positioned above said condensate well in flow communication therewith, and being sloped relative to one another in a manner such that essentially all condensation entering any of said interconnected troughs flows by gravity to and into said condensate well for discharge therefrom through said outlet opening.

2. The air conditioning apparatus of claim 1 wherein:

said interconnected troughs border an open air flow area and include first and second facing, spaced apart and generally parallel troughs, and third and fourth facing, spaced apart and generally parallel troughs transverse to and connected to said first and second troughs, said first and fourth troughs joining at a juncture area, and said drain structure is disposed at said juncture area.

3. The air conditioning apparatus of claim 2 wherein:

with said drain pan in said vertical air flow orientation thereof said first and second troughs slope downwardly toward said fourth trough, a first longitudinal portion of said third trough slopes downwardly toward said first trough, a second longitudinal portion of said third trough slopes downwardly toward said second trough, and said fourth trough slopes downwardly toward said first trough.

4. The air conditioning apparatus of claim 3 wherein:

said drain structure has a condensate overflow opening which, with said drain pan in said vertical air flow orientation thereof, is disposed higher than said outlet opening.

5. The air conditioning apparatus of claim 1 further comprising:

a coil, said drain pan being operatively associated with said coil to receive condensate therefrom.

6. The air conditioning apparatus of claim 5 wherein:

said coil is a cooling coil.

7. The air conditioning apparatus of claim 6 wherein:

said cooling coil is a refrigerant coil.

8. The air conditioning apparatus of claim 5 wherein:

said air conditioning apparatus is an air conditioning unit in which said coil and said drain pan are operatively incorporated.

9. The air conditioning apparatus of claim 1 wherein:

said drain pan is of a molded plastic construction.

10. The air conditioning apparatus of claim 5 wherein:

said air conditioning apparatus further comprises a wall structure defining an air flow path, and said coil and said drain pan are positioned within said wall structure.

11. The air conditioning apparatus of claim 1 wherein:

said coil drain pan is further positionable in a horizontal air flow orientation, said drain structure is connected to a first one of said troughs which, with said drain pan in said horizontal air flow orientation thereof, is in a generally horizontal orientation; and said drain pan further includes a drip shield structure connectable to said drain pan, at said first trough, without sealant or separate fasteners, the connected drip shield structure being operative to receive coil condensation and flow the received condensation by gravity into said first trough.

12. The air conditioning apparatus of claim 11 wherein:

said drain structure has a condensate overflow opening which, with said drain pan in said horizontal air flow orientation thereof, is disposed higher than said outlet opening.

13. The air conditioning apparatus of claim 11 further comprising:

a coil, said drain pan being operatively associated with said coil to receive condensate therefrom.

14. The air conditioning apparatus of claim 13 wherein:

said coil is a cooling coil.

15. The air conditioning apparatus of claim 14 wherein:

said cooling coil is a refrigerant coil.

16. The air conditioning apparatus of claim 13 wherein:

said air conditioning apparatus is an air conditioning unit in which said coil and said drain pan are operatively incorporated.

17. The air conditioning apparatus of claim 13 wherein:

said air conditioning apparatus is an air handling unit in which said cooling coil and said drain pan are operatively incorporated.

18. The air conditioning apparatus of claim 11 further comprising:

cooperating structures on said drain pan and said drip shield which may be press-fitted together to operatively connect said drip shield to said drain pan.

19. The air conditioning apparatus of claim 18 wherein said cooperating structures comprise:

a support wall disposed on said first trough, a spaced plurality of resilient retaining tabs formed on said support wall and extending parallel thereto, and a spaced plurality of locking projections formed on a portion of said drip shield, said portion of said drip shield being press-fittable between said support wall and said retaining tabs to cause said locking projections to engage said retaining tabs in a manner operatively securing said drip shield to said drain pan.

20. The air conditioning apparatus of claim 19 wherein:

said locking projections are lanced-out portions of said drip shield.

21. Air conditioning apparatus comprising:

a coil drain pan having a generally frame-shaped drainage trough portion bordering an air flow opening through which air may flow in an air flow direction, and a drain structure coupled to said drainage trough portion and operative to discharge condensation therefrom; and a drip shield structure connectable to said drain pan, without sealant or separate fasteners, to extend outwardly from said drainage trough portion in a direction generally parallel to said air flow direction, the connected drip shield structure being operative to receive cooling coil condensation and flow it into said trough portion of said coil drain pan when said drainage trough portion is oriented in a manner such that said air flow direction extends generally horizontally.

22. The air conditioning apparatus of claim 21 further comprising:

a coil, said drain pan being operatively associated with said cooling coil to receive condensation therefrom.

23. The air conditioning apparatus of claim 22 wherein:

said coil is a cooling coil.

24. The air conditioning apparatus of claim 23 wherein:

said cooling coil is a refrigerant coil.

25. The air conditioning apparatus of claim 22 wherein:

said air conditioning apparatus is an air conditioning unit in which said cooling coil and said drain pan are operatively incorporated.

26. Air conditioning apparatus comprising:

a coil drain pan having a drainage trough portion to which a drain structure is coupled and operative to discharge condensation therefrom;

a drip shield structure connectable to said drain pan, without sealant or separate fasteners, the connected drip shield structure being operative to receive cooling coil condensation and flow it into said trough portion of said drain pan;

a coil, said coil drain pan being operatively associated with said cooling coil to receive condensation therefrom; and a wall structure defining an air flow path, said coil and said coil drain pan being positioned within said wall structure.

27. The air conditioning apparatus of claim 21 further comprising:

cooperating structures on said drain pan and said drip shield which may be press-fitted together to operatively connect said drip shield to said drain pan.

28. Air conditioning apparatus comprising:

a coil drain pan having a drainage trough portion to which a drain structure is coupled and operative to discharge condensation therefrom;

a drip shield structure connectable to said drain pan, without sealant or separate fasteners, the connected drip shield structure being operative to receive cooling coil condensation and flow it into said trough portion of said coil drain pan; and cooperating structures on said drain pan and said drip shield which may be press-fitted together to operatively connect said drip shield to said coil drain pan, said cooperating structures comprising:

a support wall disposed on said drainage trough portion, a spaced plurality of resilient retaining tabs formed on said support wall and extending parallel thereto, and a spaced plurality of locking projections formed on a portion of said drip shield, said portion of said drip shield being press-fittable between said support wall and said retaining tabs to cause said locking projections to engage said retaining tabs in a manner operatively securing said drip shield to said coil drain pan.

29. The air conditioning apparatus of claim 28 wherein:

said locking projections are lanced-out portions of said drip shield.

* * * * *